United States Patent [19]

Riegler et al.

[11] 4,200,210

[45] Apr. 29, 1980

[54] ROTARY SLIDE CLOSURE

[75] Inventors: Ernst Riegler, Enns; Manfred Schmidt, Linz, both of Austria

[73] Assignee: Voest-Alpine Aktiengesellschaft, Linz, Austria

[21] Appl. No.: 936,118

[22] Filed: Aug. 23, 1978

[30] Foreign Application Priority Data

Sep. 16, 1977 [AT] Austria ..... 6659/77

[51] Int. Cl.[2] ..... B22D 41/10

[52] U.S. Cl. ..... 222/598; 222/512; 251/309

[58] Field of Search ..... 222/591, 598, 603, 548, 222/597, 512; 251/309, 310

[56] References Cited

U.S. PATENT DOCUMENTS

| | | | |
|---|---|---|---|
| 460,575 | 10/1891 | Grace | 222/601 |
| 3,556,360 | 1/1971 | Stelson | 222/601 X |
| 3,679,105 | 7/1972 | Ratcliffe | 222/591 |

FOREIGN PATENT DOCUMENTS

| | | | |
|---|---|---|---|
| 165292 | 7/1949 | Austria | 222/598 |
| 2608472 | 2/1976 | Fed. Rep. of Germany | 222/598 |
| 270205 | 9/1958 | U.S.S.R. | 222/598 |

*Primary Examiner*—David A. Scherbel

*Attorney, Agent, or Firm*—Brumbaugh, Graves, Donohue & Raymond

[57] ABSTRACT

A rotary slide closure for a vessel provided with a fireproof lining includes a closure block contacting a beveled seat of a seat block and being rotatably mounted relative to the seat block. The closure block and the seat block each have at least one flow-through opening which can be brought into register by turning of the closure block so as to form a pouring channel extending from the center of the closure block. The surface of the seat block forming the beveled seat, faces the interior of the vessel and the closure block contacts the surface forming the bevel seat from the interior of the vessel.

6 Claims, 2 Drawing Figures

ROTARY SLIDE CLOSURE

The invention relates to a rotary slide closure for vessels provided with fire-proof linings, in particular casting ladles, which closure has a closure block contacting a beveled seat of a seat block and being rotatably mounted relative to the seat block. The closure block and the seat block each comprise at least one flow-through opening which can be brought into register with each other by rotation of the closure block, thus forming a pouring channel.

It has been known in the steel industry to close pouring openings arranged in the bottom of casting ladles by means of stopper rods. Since the period of time that the metal melt remains in the casting ladle often exceeds the useful life of the stopper rod, the industry has started to use slides for opening and closing the pouring openings, which slides are arranged at the lower side of the bottom of the casting ladle. Next to the plane separating face provided between the bottom and the slide, special guiding elements with exact fits are necessary in order to secure the tight contact between the bottom and the slide that is necessary for closing the opening. Furthermore, the slide has to be ground to form a snug fit in order to guarantee sufficient tightness.

In order to avoid these disadvantages, it has been known to use a rotary slide closure for casting ladles. In this case, a beveled seat block is arranged at the vessel inner side at the outflow opening and a closure block is pressed from outside of the vessel to the seat block by means of a plate frame. The plate frame is fastened to the outer side of the casting ladle by a fastening arrangement which in turn is fastened to the ladle by means of screws. The disadvantage of this known rotary slide closure is that, after a certain period of operation, signs of wear occur on both parts, which are rotatable relative to each other to align pouring channels within them, at the bevel seat, and consequently a certain play will form between those parts. The penetration of molten metal between those parts may lead to a blockage of the rotary slide closure. Therefore it is necessary to continuously check the known rotary slide closure for the possible existence of play, and to eliminate this play in time by readjusting the fastening screws.

SUMMARY OF THE INVENTION

The invention aims at avoiding these disadvantages and difficulties and has as its object to provide a rotary slide closure of the initially-defined kind with which no play can occur between the closure block and the seat block, i.e. the contact of the closure block with the seat block is to be guaranteed by the construction, without having to provide special readjustable fastening means.

This object is achieved according to the invention in that the surface of the seat block forming the bevel seat faces the interior of the vessel, and that the closure block contacts the surface forming the bevel seat from the interior of the vessel. The closure block is continuously pressed against the seat block by the hydrostatic pressure due to the melt within the vessel. As a result no play can occur between these two blocks and the function, as well as the tightness, of the closure will always be ensured. When the metallurgical vessel has been emptied, the tightness of the closure during the filling of melt into the vessel at the beginning of the filling-in procedure is guaranteed by the closure block's own weight.

Suitably, the closure block is provided with an operating extension projecting to the outer side of the vessel.

According to a preferred embodiment, the seat block, at its outer circumference, has a conical sealing face facing the interior of the vessel and is pressed via a pressure plate against the fire-proof lining of the vessel by means of tightening means, such as screw bolts, arranged at the outer wall of the vessel. By this means, the seat block can be easily removed and installed and sealed off relative to the fire-proof lining.

Advantageously, the operating extension of the closure block is designed as a bolt centrally penetrating the seat block and attached along the center axis of the closure block. Also, the flow-through opening in the closure block originates along the center axis and slopes to one side as it extends into the flow-through opening of the seat block.

In order to secure the closure block against undesired axial displacement towards the interior of the vessel, the bolt suitably penetrates a supporting plate arranged at the side of the seat block facing the outer side of the vessel, and is provided with a collar contacting the outer side of the supporting plate.

BRIEF DESCRIPTION OF THE DRAWING

The invention will be explained in more detail by way of one embodiment and with reference to the accompanying drawing, wherein.

DESCRIPTION OF A PREFERRED EMBODIMENT

Figure 1:
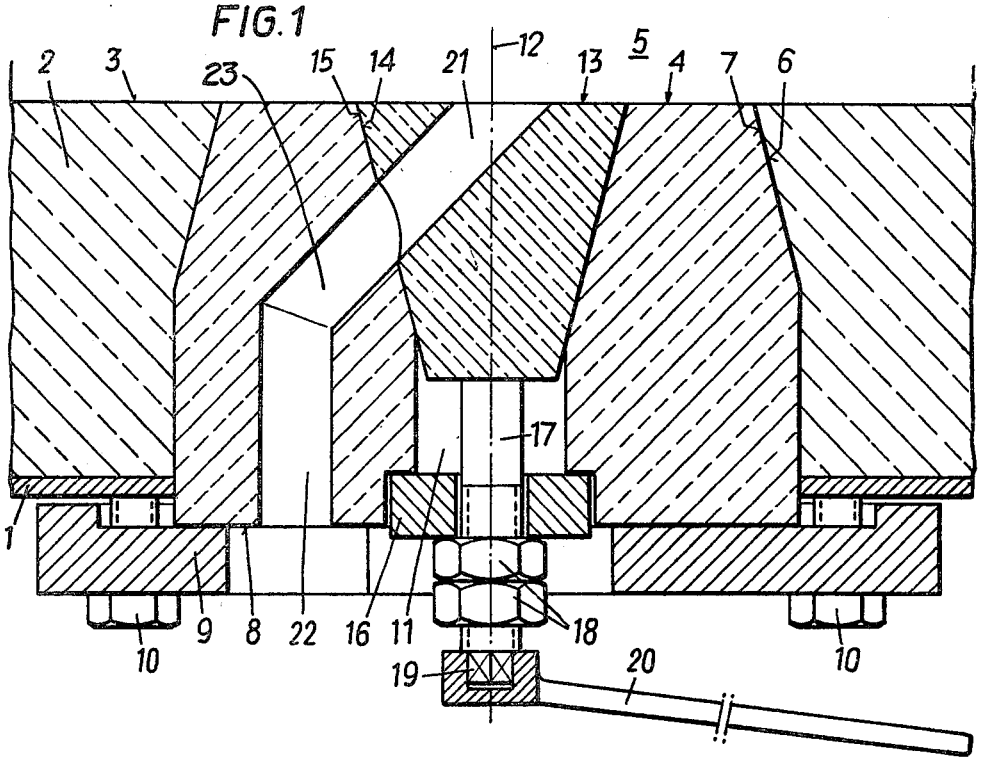
FIG. 1 illustrates the rotary slide closure in vertical section, in the open state, and FIG. 2 gives an analogous illustration of FIG. 1, in the closed state.
Figure 2:
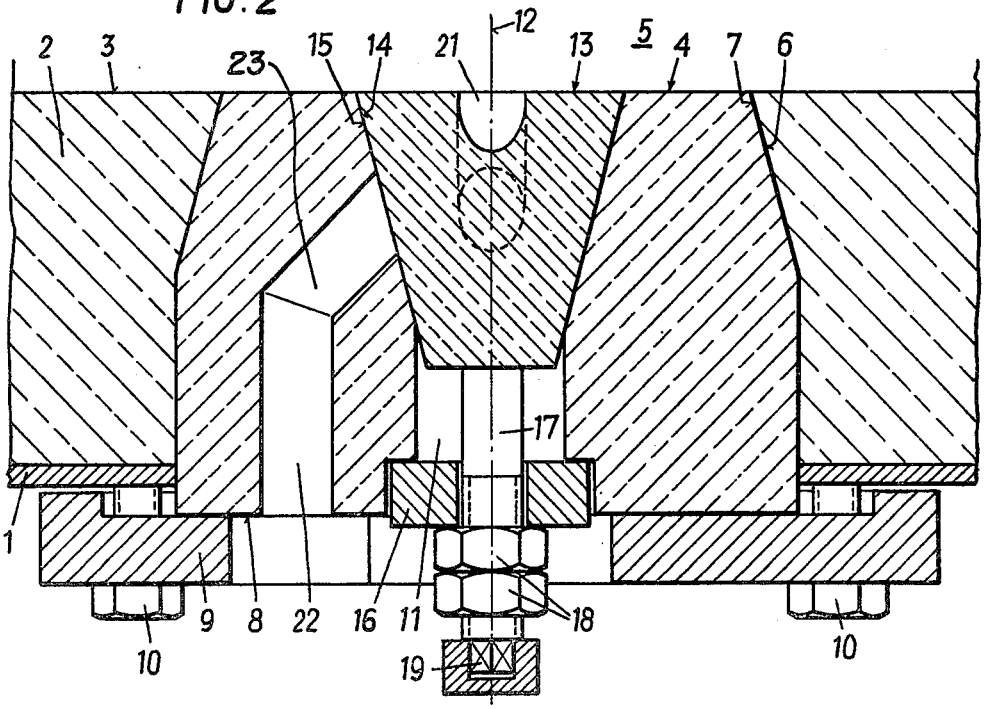

The steel plate jacket of a metallurgical vessel with a fire-proof lining 2, such as a casting ladle, is denoted by 1. At the lowermost part of the bottom 3 of the metallurgical vessel, which is illustrated in section in the Figures, a seat block 4 is inserted in a recess of the jacket plate and the fire-proof lining. The seat block, at its outer circumference, comprises a conical sealing face 6 facing the interior 5 of the vessel and sealingly contacting a corresponding conical counterface 7 of the lining 2 which faces the outer side of the vessel. For safely securing the seat block 4 in the bottom 3 of the vessel, a pressure plate 9 is provided for contacting a side face 8 of the seat block 4 which faces the outer side of the vessel. By means of the pressure plate the seat block 4 is pressed against the interior 5 of the vessel and thus against the conical counter face 7 of the fire-proof lining. For controlling the pressure of the seat block against the face 7, tightening means, such as screw bolts 10, are provided. There could also be provided pins that are anchored on the steel plate jacket and in which wedges contacting the pressure plate are inserted.

The seat block 4 has a central passage 11 whose upper part, which borders the interior of the vessel, serves as a beveled seat for accommodation of a closure block 13 which is mounted relative to the seat block 4 so as to be rotatable about the vertical central axis 12. The surface 14 of the seat block 4, that forms the beveled seat, faces the interior 5 of the vessel, and the closure block contacts that surface from the interior 5 of the vessel with a corresponding conical counter face 15. The opening angle of the surface 14 forming the bevel seat is larger than the friction angle of the friction that occurs during rotation of the closure block 13 with respect to the seat block 4, so that no self-locking may occur when operating the rotary slide closure.

At the side face 8 of the seat block facing the outer side of the vessel, a supporting plate 16 is provided, which plate is centrally penetrated by an operating extension anchored in the closure block and designed as a bolt 17. The bolt 17 is provided with a collar formed by two nuts 18 that contact the supporting plate 16 from the outside, thus preventing lifting of the closure block 13 from the seat block 4. The end of the bolt 17 is designed as a square 19, on which a wrench 20 provided with a corresponding inner square can be slipped. Both the closure block 13 and the seat block 4 have flow-through openings, 21 and 22, which can be brought into register by rotation of the closure block, thus forming a pouring channel. Opening 21 begins at the center axis 12 of the closure block 13 and extends at an angle through the closure block. When the pouring channel is open (FIG. 1), the opening 21 is aligned with the upper part of channel 22 of the seat block which also extends at an angle. At a knee 23 the opening 22 bends so that it is parallel to the axis 12 and proceeds through the rest of the seat block 4 to the outside of the vessel.

The invention is not limited to the embodiment illustrated in the drawings, but can be modified in many ways. Thus, the rotary slide closure according to the invention is not bound to a certain installation position, i.e. it can be arranged also at a side wall of a metallurgical vessel, the rotation axis 12 of the closure block then being inclined or in a horizontal position. It is also possible to design the surface of the seat block so that the beveled seat is chamfered towards the interior of the vessel.

What we claim is:

1. In a rotary slide closure for a vessel having an interior and provided with a fire-proof lining, in particular a casting ladle, of the type including a seat block having a surface forming a beveled seat, a closure block with a beveled surface contacting said seat block at said beveled seat and being rotatably mounted relative to said seat block, said closure block and said seat block each having at least one flow-through opening, said at least one flow-through opening of said closure block being capable of being brought into register with said at least one flow-through opening of said seat block, so as to form a pouring channel, by rotation of said closure block about a central axis, the improvement comprising said surface of said seat block that forms said beveled seat facing said interior of said vessel, said closure block contacting the surface of said seat block forming said beveled seat from the interior of the vessel, and said pouring channel extending from the interior of the vessel at the location of said central axis in said closure block to the exterior of the vessel at a point in said seat block laterally displaced from said central axis, said pouring channel running obliquely from the central axis towards said seat block and making a knee-shaped bend within said seat block to form a section, approximately parallel to and lateral of the central axis of the closure block, leading to the exterior of the vessel.

2. A rotary slide closure as set forth in claim 1, wherein said closure block is provided with an operating extension for the rotation of said closure block about the central axis, said operating extension projecting to the outside of said vessel.

3. A rotary slide closure as set forth in claim 2, wherein said operating extension of said closure block is designed as a bolt centrally penetrating said seat block.

4. A rotary slide closure as set forth in claim 3, wherein said vessel has an outer side and said seat block has a side facing said outer side of said vessel, and further comprising a supporting plate arranged at said side of said seat block facing said outer side of said vessel, said bolt penetrating said supporting plate, a collar being provided around said bolt, said collar contacting said supporting plate at the outer side thereof.

5. A rotary slide closure as set forth in claim 1, wherein said seat block has a conical sealing face at its outer circumference, said conical sealing face facing said interior of said vessel, and further comprising tightening means arranged on the outside of said vessel, and a pressure plate, said tightening means pressing said seat block against said fire-proof lining of said vessel via said pressure plate.

6. A rotary slide closure as set forth in claim 5, wherein said tightening means are screw bolts.

* * * * *